US008718312B2

(12) United States Patent
Lin

(10) Patent No.: US 8,718,312 B2
(45) Date of Patent: May 6, 2014

(54) EARMUFF AND HEADSET WITH THE SAME

(75) Inventor: Yin Yu Lin, New Taipei (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 103 days.

(21) Appl. No.: 13/492,683

(22) Filed: Jun. 8, 2012

(65) Prior Publication Data

US 2013/0142376 A1 Jun. 6, 2013

(30) Foreign Application Priority Data

Dec. 2, 2011 (TW) ..... 100144534 A

(51) Int. Cl.
*H04R 25/00* (2006.01)

(52) U.S. Cl.
USPC ..... 381/373; 181/129

(58) Field of Classification Search
USPC ..... 381/370–374; 181/129
See application file for complete search history.

(56) References Cited

U.S. PATENT DOCUMENTS

| | | | | |
|---|---|---|---|---|
| 5,729,605 | A * | 3/1998 | Bobisuthi et al. | 379/430 |
| 2005/0105755 | A1* | 5/2005 | Yueh | 381/371 |
| 2009/0232340 | A1* | 9/2009 | Yang | 381/371 |

* cited by examiner

*Primary Examiner* — Curtis Kuntz
*Assistant Examiner* — Sunita Joshi
(74) *Attorney, Agent, or Firm* — Chun-Ming Shih

(57) ABSTRACT

An earmuff which is adapted to covering a driver includes a first case having a first through hole and a second case having a second through hole. The second case accommodated within the first case to form an inner chamber where the driver is disposed therein. Since air flows between the first case and the second case via the first through hole and the second through hole, a satisfactory ventilation effect can be achieved and thus feeling of being at ease can be furnished.

7 Claims, 13 Drawing Sheets

EARMUFF AND HEADSET WITH THE SAME

This application claims the benefit of the filing date of Taiwan Patent Application No. 100144534, filed on Dec. 2, 2011, in the Taiwan Intellectual Property Office, the disclosure of which is incorporated herein in its entirety by reference.

BACKGROUND OF THE INVENTION

1. Field of Invention

The present invention relates to an earmuff and a headset with the same; in particular, relates to an earmuff that possesses a through hole and a headset with the same.

2. Related Art

There are several versions of headsets currently, such as a small-sized in-ear type, an ear hook type, or a circumaural type, to satisfy various user requirements. Generally speaking, the in-ear headset is applied prevalently in the mobile applications that require a small size, lightweight and convenience. However, the design of the in-ear earphone is often limited and simplified, so that the sound quality thereof is not satisfactory.

Among them, the circumaural headset earphone usually has a better sound quality with a more complicated design of the component and the circuit therein. The better sound quality is basically provided by a proper circuit design associated with the speaker and the driver. Consequently, the size and weight of the circumaural headset earphone are more significant.

The components of the current circumaural headset, especially the speaker and the driver, are commonly housed in the earmuff. For the purposes of external noise attenuation and internal circuit protection, the structure of the earmuff is usually designed to be almost fully sealed. Besides, the earmuff of the circumaural headset is provided with an earpad or the like that encompasses the ear.

Because the earmuff surrounds the ear completely, discomfort resulted from for example stuffiness or weight will arise after the use of the circumaural headset for a long period of time. So the wearer tends to decrease his/her time of the use of such headset.

In addition, the problem of the stuffiness caused by a long-term use further makes the wearer sweat and heat generated by the working electronic components is gradually accumulated during this period. The moisture and the accumulated heat may reduce the lifetime of the earphone.

SUMMARY OF THE INVENTION

In view of the foregoing, the present invention provides an earmuff and a headset with the same which can solve the problems of the conventional headset in consideration of sound quality and comfortableness.

The earmuff of the present invention is adapted to covering a driver. The earmuff includes a first case and a second case.

The first case has a first through hole defined thereon and the second case has a second through hole defined thereon. The second case is accommodated within the first case to form an inner chamber in which the driver is disposed therein.

The earmuff of the present invention further includes a shelter having a pivot and disposed between the first case and the second case, the first case further having a pivotal hole for inserting the pivot. The shelter is capable of rotating to a fully-closed, semi-closed or an open position with respect to the first case.

The present invention further discloses a headset including at least two drivers, two earmuffs each including a first case and a second case and a headband connected the two earmuffs. The first case has a first through hole defined thereon and the second case has a second through hole defined thereon. The second case is accommodated within the first case to form an inner chamber in which the drivers are disposed therein. Furthermore, air flows between the first case and the second case via the first through hole and the second through hole.

The headset of the present invention further includes a shelter having a pivot and disposed between the first case and the second case, the first case further having a pivotal hole for inserting the pivot. The shelter is capable of rotating to a fully-closed, semi-closed or an open position with respect to the first case.

The earmuff and the headset with the same of the present invention provide not only more integrated functions but also better sound quality, and the problems resulted from the enclosed structure of the conventional earmuff are solved by the design of the through hole defined on the earmuff to facilitate air flow for the heat dissipation via convection.

Besides, in coordination with the location of the driver, the effect of the sound wall barrier may be produced to reduce the external noise, and the requirements of both the sound quality and ventilation may be satisfied at the same time.

Moreover, design of the shelter makes it possible for the wearer to determine whether to open the through hole or not. In this way, the wearer is allowed to regulate the circumference openness of the through hole at his/her option easily, thereby increasing the convenience of use.

Further objects, embodiments and advantages are apparent in conjunction with the drawings and the detailed description which follows.

DETAIL DESCRIPTION OF THE INVENTION

Figure 1:
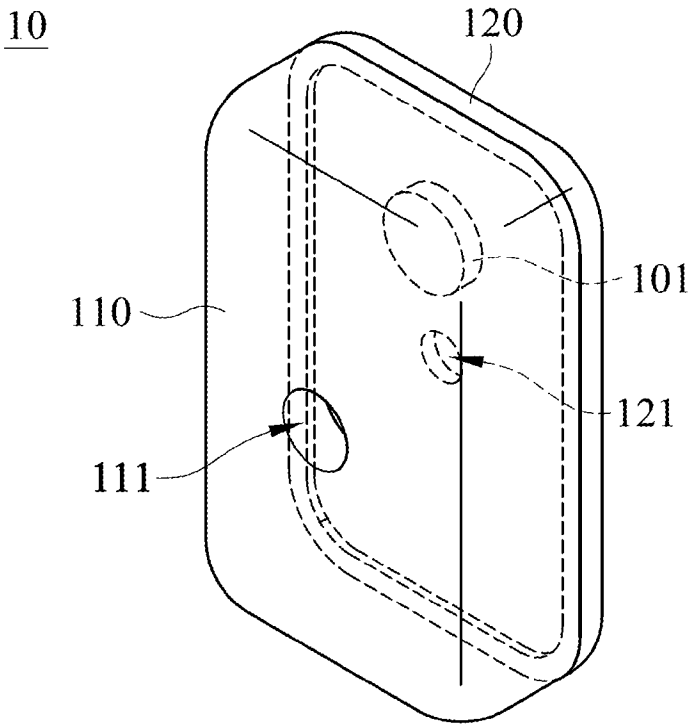
FIG. 1 illustrates a three-dimensional view of an earmuff of a first embodiment according to the present invention.
Figure 2:
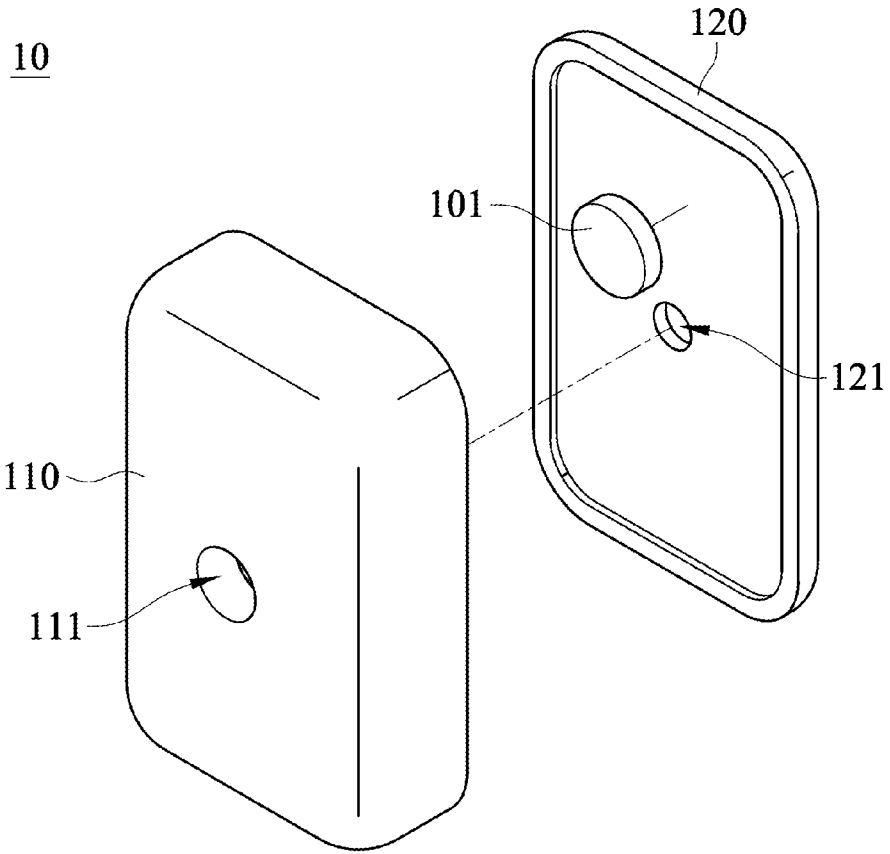
FIG. 2 illustrates an exploded view of an earmuff of the first embodiment according to the present invention.

FIG. 1 illustrates a three-dimensional view of an earmuff of a first embodiment according to the present invention. FIG. 2 illustrates an exploded view of an earmuff of the first embodiment according to the present invention.

The earmuff 10 of the first embodiment which is adapted to covering a driver 101 includes a first case 110 and a second case 120.

The first case 110 has a first through hole 111 defined thereon and the second case 120 has a second through hole 121 defined thereon. The second case 120 is accommodated within the first case 110 to form an inner chamber in which the driver 101 is disposed therein.

The first through hole 111 and the second through hole 121 are configured for heat dissipation via convection. In particular, air flows between the first case 110 and the second case 120 via the first through hole 111 and the second through hole 121 for better heat dissipation and ventilation.

The first through hole 111 and the second through hole 121 function to dissipate the heat or moisture (by convection) from the electronic components or the wearer, even though the ear is almost completely covered by the earmuff 10. In this way, on one hand, the wearer may not feel uncomfortable in spite of a continuous use for many hours because it is the one with good ventilation; on the other hand, since the problems of moisture and heat accumulation are solved effectively in this manner, the possibility of reduced functionality and lifetime of the headset is minimized.

It is to be noted that the number (one) of each of the first through hole 111 and the second through hole 121 in the first embodiment is only illustrative rather than limitative. The number of more than one is possible in the present invention and it may be determined depending on one's need.

In practice, one single first through hole 111 together with one single second through hole 121 are sufficient for the effect of heat dissipation and ventilation.

However, preferably, a more appropriate number of the first through holes 111 and four second through holes 121 is four respectively. Under this condition, more air flow paths are formed between the first case 110 and the second case 120 via the arrangement of the first through holes 111 and the second through holes 121, thereby facilitating the heat transfer rate of the earmuff 10.

Figure 3B:
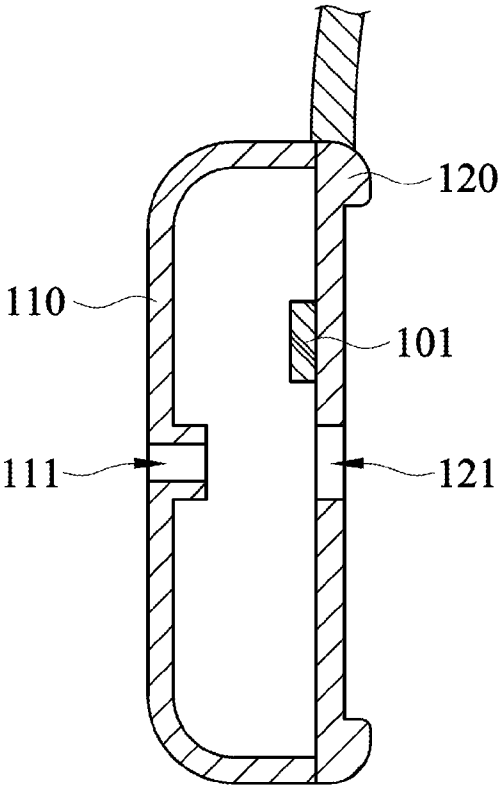
FIG. 3B illustrates a cross-sectional view of an earmuff of a third embodiment according to the present invention.
Figure 3A:
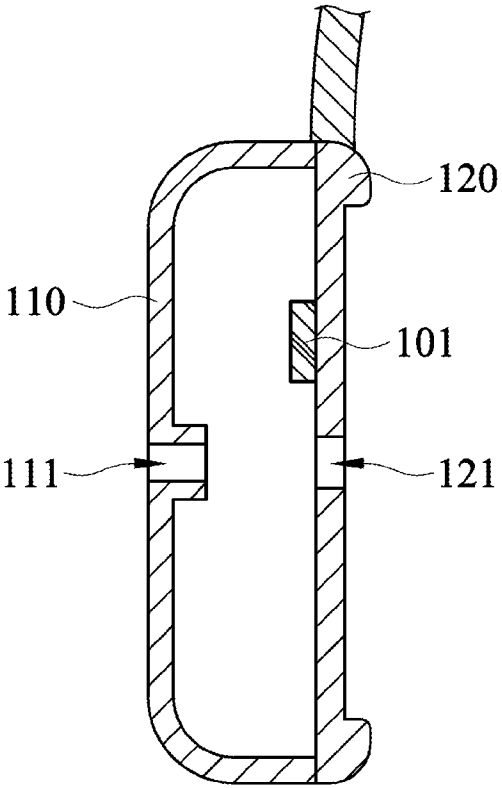
FIG. 3A illustrates a cross-sectional view of an earmuff of a second embodiment according to the present invention.

FIG. 3A illustrates a cross-sectional view of an earmuff of a second embodiment according to the present invention. The structure of the earmuff of the present embodiment is similar to the first embodiment except one single first through holes 111 and one single second through holes 121 are arranged oppositely.

FIG. 3B illustrates a cross-sectional view of an earmuff of a third embodiment according to the present invention. The structure of the earmuff of the present embodiment is similar to the aforesaid embodiments except the circumference of the first through hole 111 is relatively smaller than that of the second through hole 121.

Although not limited to those disclosed in the embodiments of the present invention, the circumference of the first through hole 111 and the second through hole 121 may be properly designed and arranged. Because if the circumferences thereof are too small, the effect of heat dissipation and ventilation caused by air flow will not be quite apparent; on the contrary, if the circumferences thereof are too large, the sound quality will be influenced unfavorably by the intrusive external noise.

Therefore, preferably, the second through hole 121 nearer to the ear has a larger circumference to afford the wearer comfortableness due to better heat dissipation and ventilation, and the first through hole 111 farther from the ear has a smaller circumference to decrease the external noise as much as possible and also to provide the functions of ventilation and heat dissipation to a certain extent. Accordingly, the circumference of the first through hole 111 is arranged to be relatively smaller than that of the second through hole 121 in the third embodiment.

More preferably, the circumferences of the first through hole 111 and the second through hole 121 may range between 5 mm to 10 mm. Thus, the earmuff and the headset with the same of the present invention not only provide comfortable feeling but are also efficacious in furnishing a better sound quality.

Figure 3D:
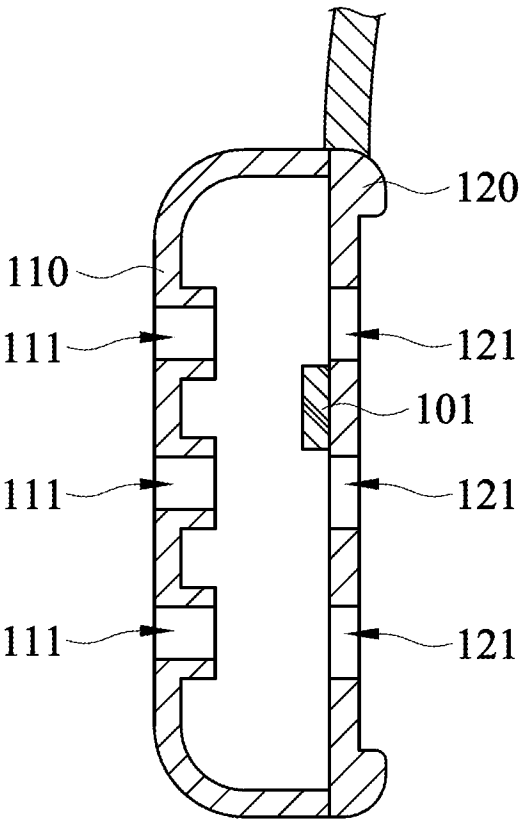
FIG. 3D illustrates a cross-sectional view of an earmuff of a fifth embodiment according to the present invention.
Figure 3C:
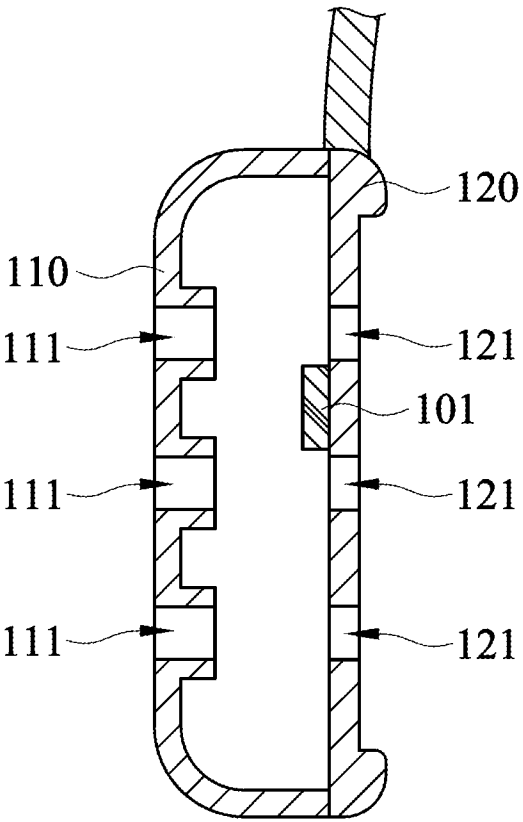
FIG. 3C illustrates a cross-sectional view of an earmuff of a fourth embodiment according to the present invention.

FIG. 3C illustrates a cross-sectional view of an earmuff of a fourth embodiment according to the present invention. The structure of the earmuff of the present embodiment is similar to the aforesaid embodiments except the numbers of the first through holes 111 and the second through holes 121 which are opposed to each other are plural and equal.

FIG. 3D illustrates a cross-sectional view of an earmuff of a fifth embodiment according to the present invention. The structure of the earmuff of the present embodiment is similar to the fourth embodiment except the circumference of the first through hole 111 is relatively smaller than that of the second through hole 121. It is preferable that the circumference of the first through hole 111 may be equal to or less than that of the second through hole 121 in the present invention.

Figure 4:
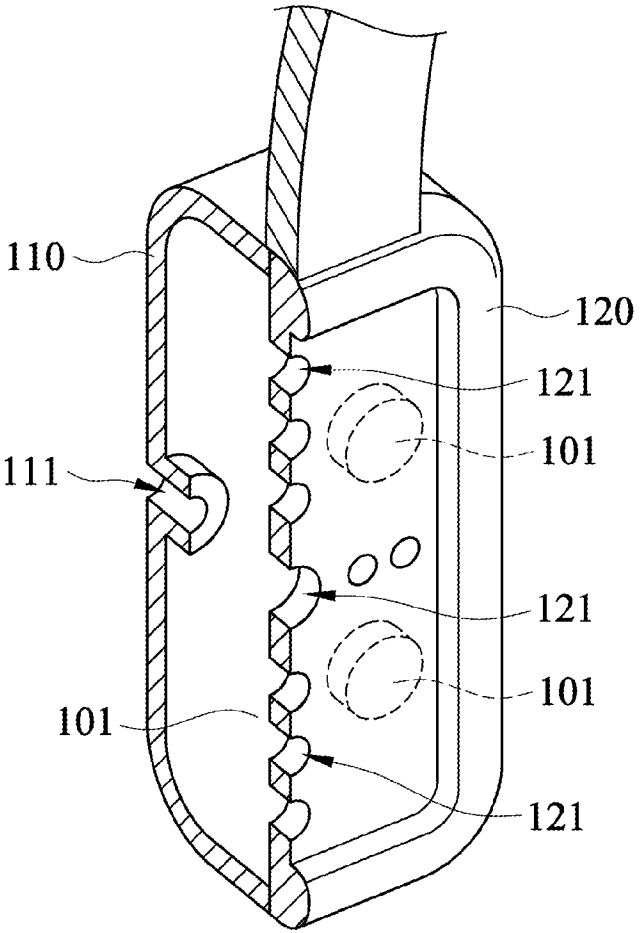
FIG. 4 illustrates a cross-sectional view of an earmuff of a sixth embodiment according to the present invention.

FIG. 4 illustrates a cross-sectional view of an earmuff of a sixth embodiment according to the present invention. The structure of the earmuff of the present embodiment is similar to the aforesaid embodiment except the second through holes 121 are arranged in any of various zigzags, alternations, or overlapping of position, the first through holes 111 in a vertical direction and the number of the former is not equal to that of the latter.

In more detail, the first through holes 111 and the second through holes 121 can be arranged correspondingly in both of the position and number or arranged in any of various zigzags, alternations, or overlapping of position. For example, the number of the first through holes 111 is equal to that of the second through holes 121, while the former is not located opposite to the latter. Alternatively, the number of the first through holes 111 is not equal to that of the second through holes 121, and the former is not located opposite to the latter either, as in the sixth embodiment.

It will be appreciated that the respective numbers of the first through holes 111 and the second through holes 121 and the relative position therebetween are not limited to the embodiments of the present invention but may be determined as required.

Similarly, in the sixth embodiment, the circumference of the first through hole 111 may be equal to or less than that of the second through hole 121. In other words, the circumference of the former is not larger than that of the latter, but it will be appreciated the present invention is not limited thereto.

Figure 5:
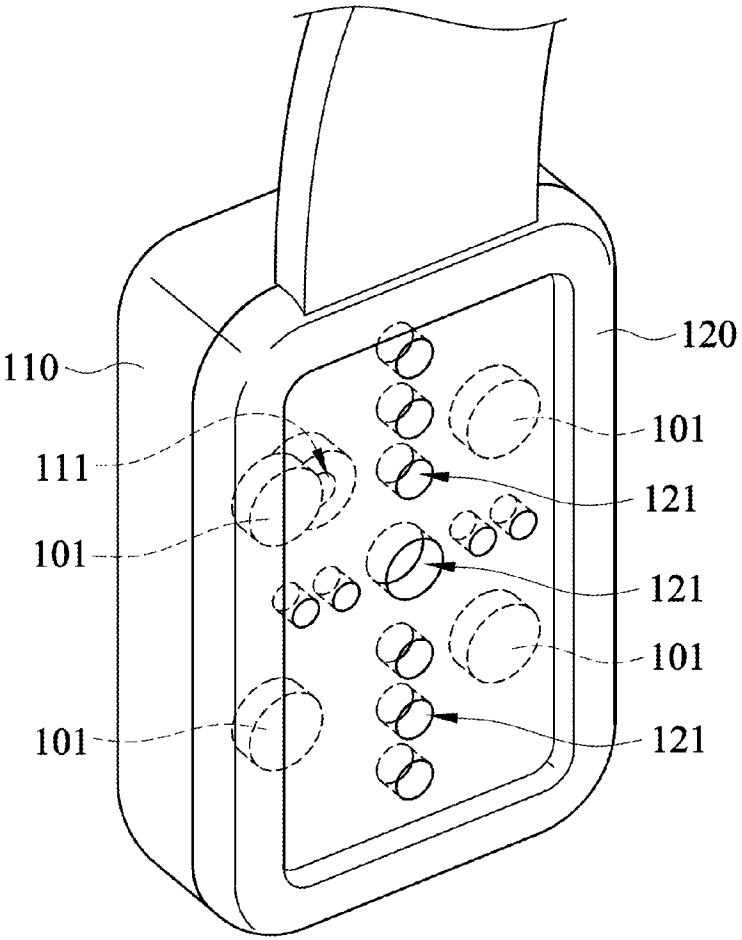
FIG. 5 illustrates a cross-sectional view of an earmuff of a seventh embodiment according to the present invention.

FIG. 5 illustrates a cross-sectional view of an earmuff of a seventh embodiment according to the present invention. The structure of the earmuff of the present embodiment is similar to the aforesaid embodiment except the second through holes 121 are formed in accordance with the position of the driver 101. The number of the driver 101 may be determined optionally and is not limited to this embodiment.

Moreover, the earmuff 10 disclosed in the present invention may be covered or protected by a decoration unit (not shown) disposed on the outer surface of the first case 110. The decoration unit serves not only to promote the whole aesthetic feeling of the earmuff but also to keep off undesirable foreign matters like dirt sand or bugs under the prerequisite that the decoration unit does not affect the heat dissipation and ventilation. The decoration unit may include for example a meshed or honeycomb structure, but it is not limited to the present invention.

As mentioned above, the earmuff and the headset with the same of the present invention provide not only more integrated functions but also better sound quality, and the problems caused by the enclosed structure of the conventional earmuff are solved by introducing the design of the through hole. The through hole defined on the earmuff facilitates air flow for the heat dissipation via convection. Also, for the purpose of the external noise attenuation, the circumference of the through holes defined on the first and second cases are different from each other, and the location of the driver in the earmuff is coordinated to form a substantial sound wall barrier system. In brief, the earmuff and the headset of the present invention may meet the requirements of both the sound quality and the ventilation effect.

Figure 6:
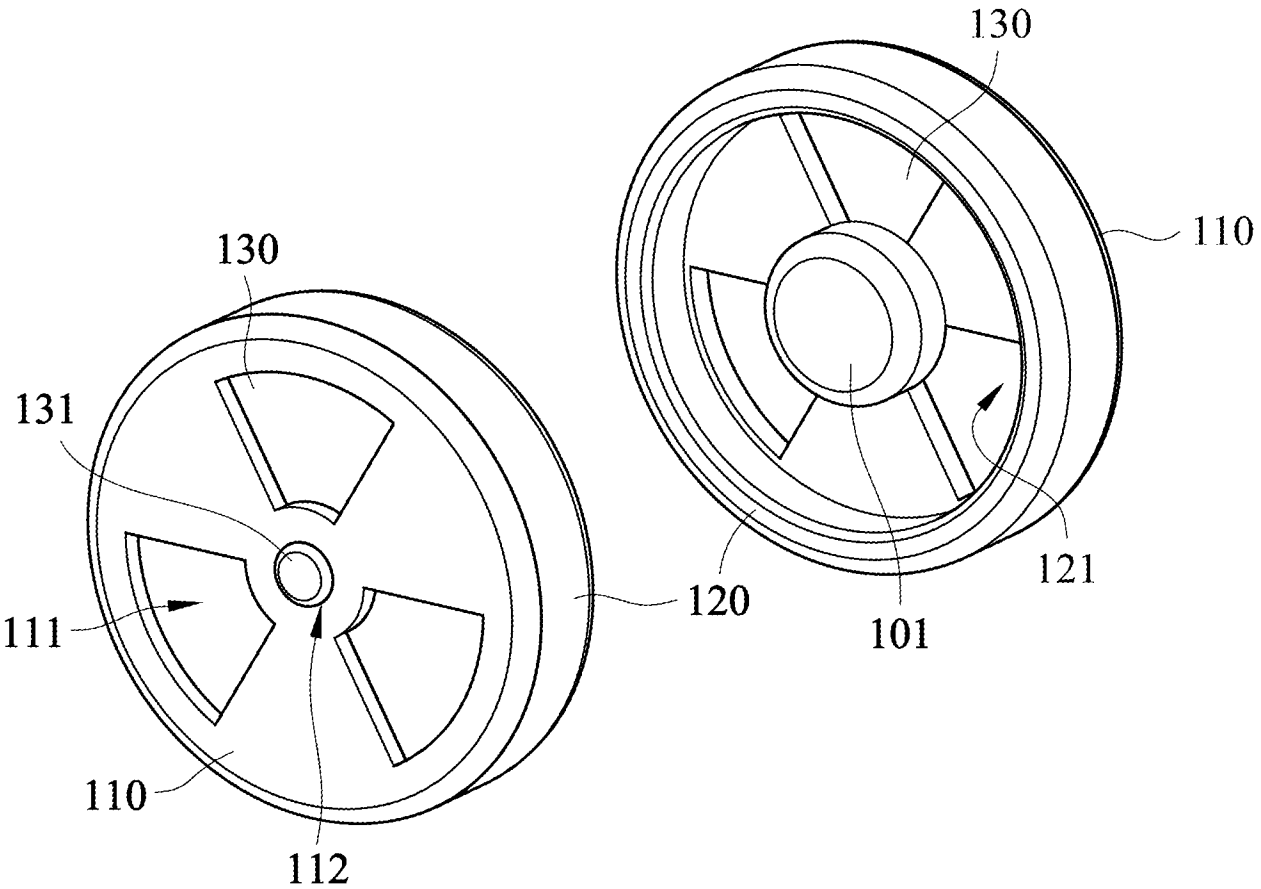
FIG. 6 illustrates a three-dimensional view of an earmuff of an eighth embodiment according to the present invention.
Figure 7:
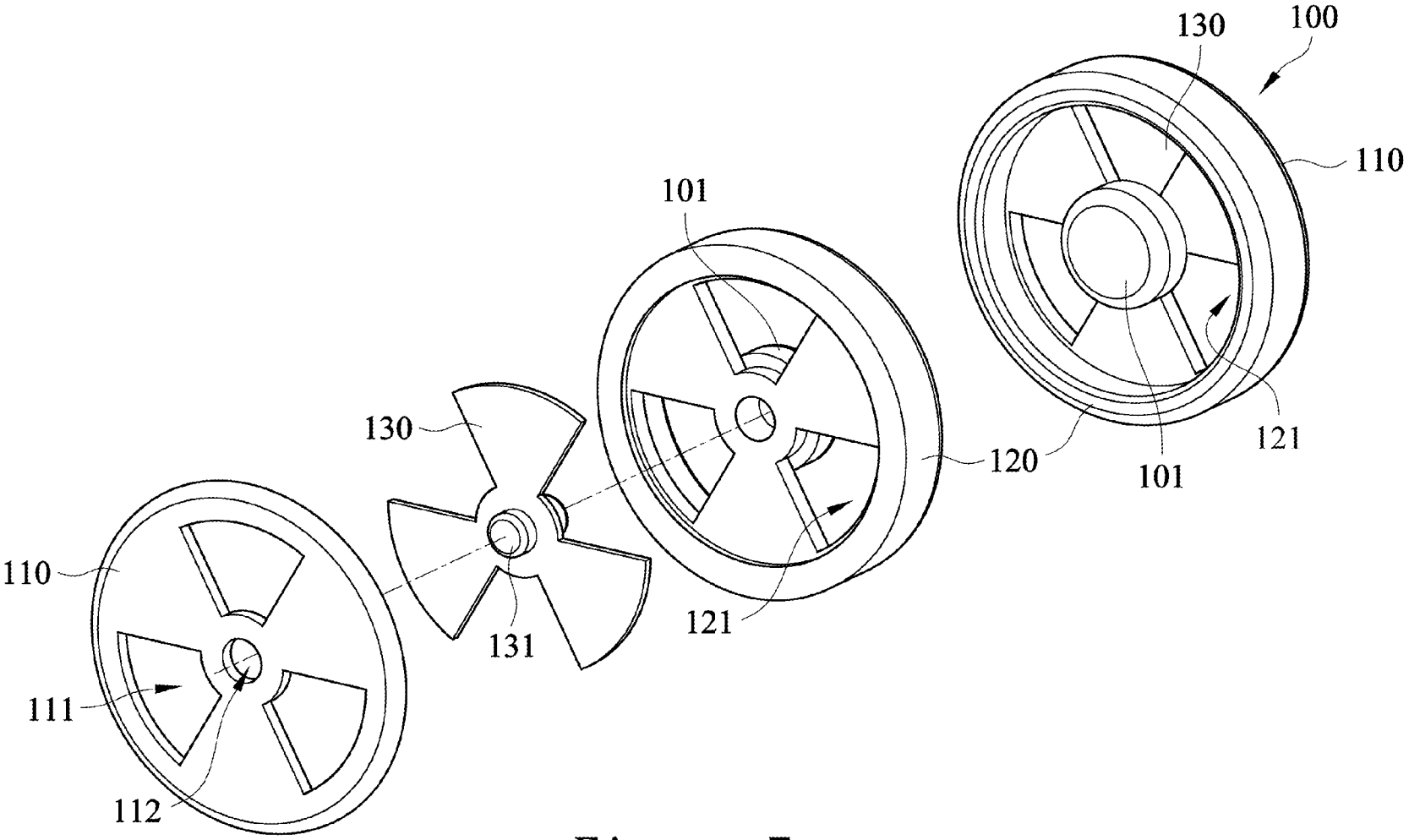
FIG. 7 illustrates an exploded view of an earmuff of the eighth embodiment according to the present invention.

FIG. 6 and FIG. 7 illustrate a three-dimensional view and an exploded view separately of an earmuff of an eighth embodiment according to the present invention.

The structure of the earmuff of the present embodiment is similar to the seventh embodiment except the earmuff further includes a shelter 130 between the first case 110 and the second case 120. A pivot 131 is provided to the shelter 130 and a corresponding pivotal hole 112 for inserting the pivot 131 that is provided on the first case 110. The shelter 130 is capable of rotating optionally with respect to the first case 110.

Figure 8A:
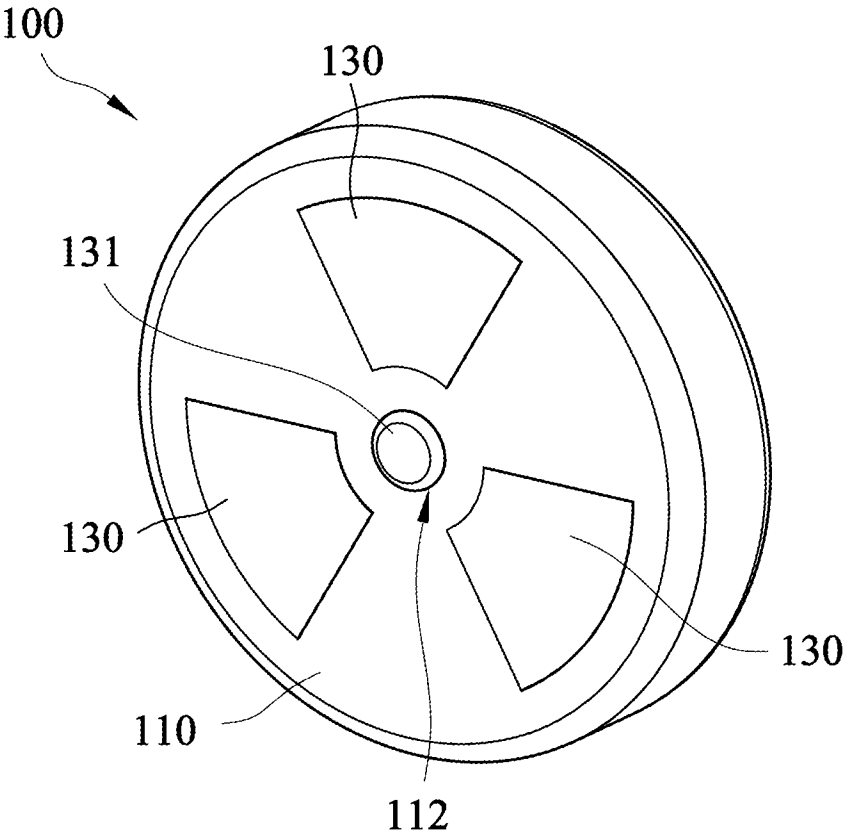
FIGS. 8A illustrates a schematic view of a fully-closed position of the earmuff of the eighth embodiment according to the present invention.
Figure 8B:
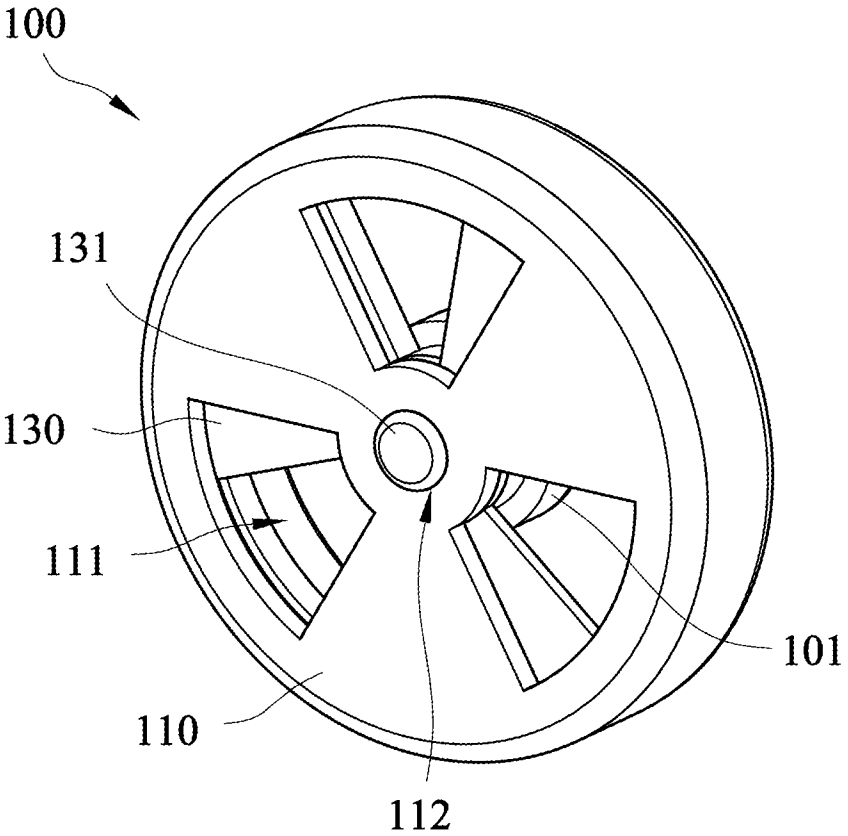
FIGS. 8B illustrates a schematic view of a semi-closed position of the earmuff of the eighth embodiment according to the present invention.
Figure 8C:
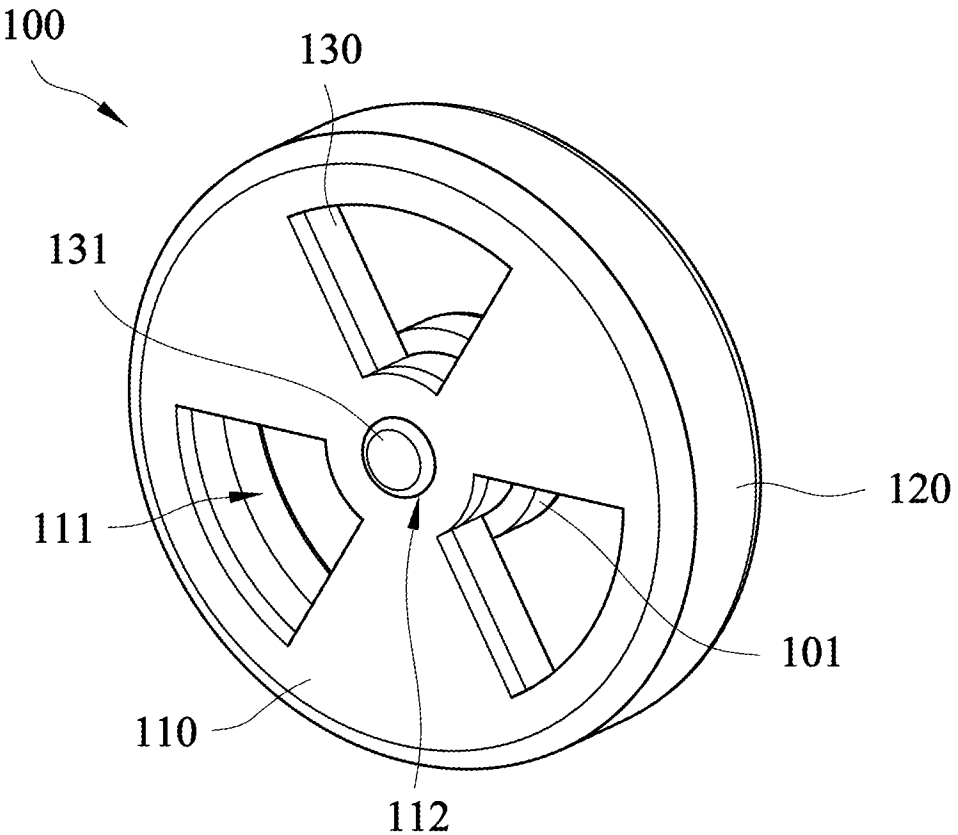
FIGS. 8C illustrates a schematic view of an open position of the earmuff of the eighth embodiment according to the present invention.

FIGS. 8A to 8C illustrate the application of the earmuff of the eighth embodiment according to the present invention.

Referring to FIG. 8A, when rotating to a fully-closed position with respect to the first case 110, the shelter 130 covers the first through hole 111 of the first case 110 entirely. Under the situation, the external noise can be isolated most efficiently and the best sound quality can be furnished.

Referring to FIG. 8B, when rotating to a semi-closed position with respect to the first case 110, the shelter 130 covers the first through hole 111 of the first case 110 only partly. Under the situation, the external noise is isolated for a certain part with the effects of heat dissipation and ventilation.

Referring to FIG. 8C, when rotating to an open position with respect to the first case 110, the shelter 130 does not cover the first through hole 111 of the first case 110 substantially. Under the situation, the effects of heat dissipation and ventilation are significant.

The number of the first through hole 111 and the second through hole 121 could respectively be one or more depending on the needs and it is not limited to the embodiments of the present invention.

In this embodiment, the first through holes 111 and the second through holes 121 can be arranged correspondingly in both of the position and the number, arranged interlacedly, or in any of various zigzags, alternations, or overlapping of position. For example, the number of the first through holes 111 is equal to that of the second through holes 121, while the former is not located opposite to the latter. Alternatively, the number of the first through holes 111 is not equal to that of the second through holes 121, and the former is not located opposite to the latter either, as in the sixth embodiment. It will be appreciated that the respective numbers of the first through holes 111 and the second through holes 121 and the relative position therebetween are not limited to the embodiments of the present invention but may be determined as required.

In this embodiment, the circumference of the first through hole 111 can be equal to or less than that of the second through hole 121. That is, the circumference of the first through hole 111 is preferably not larger than that of the second through hole 121, but the present invention is not limited thereto.

Besides, the shelter 130 of the present invention makes it possible for the wearer to determine by himself/herself whether to open the through hole or not. In this way, the wearer is allowed to adjust the sound quality and comfortableness at his/her own option.

Figure 9:
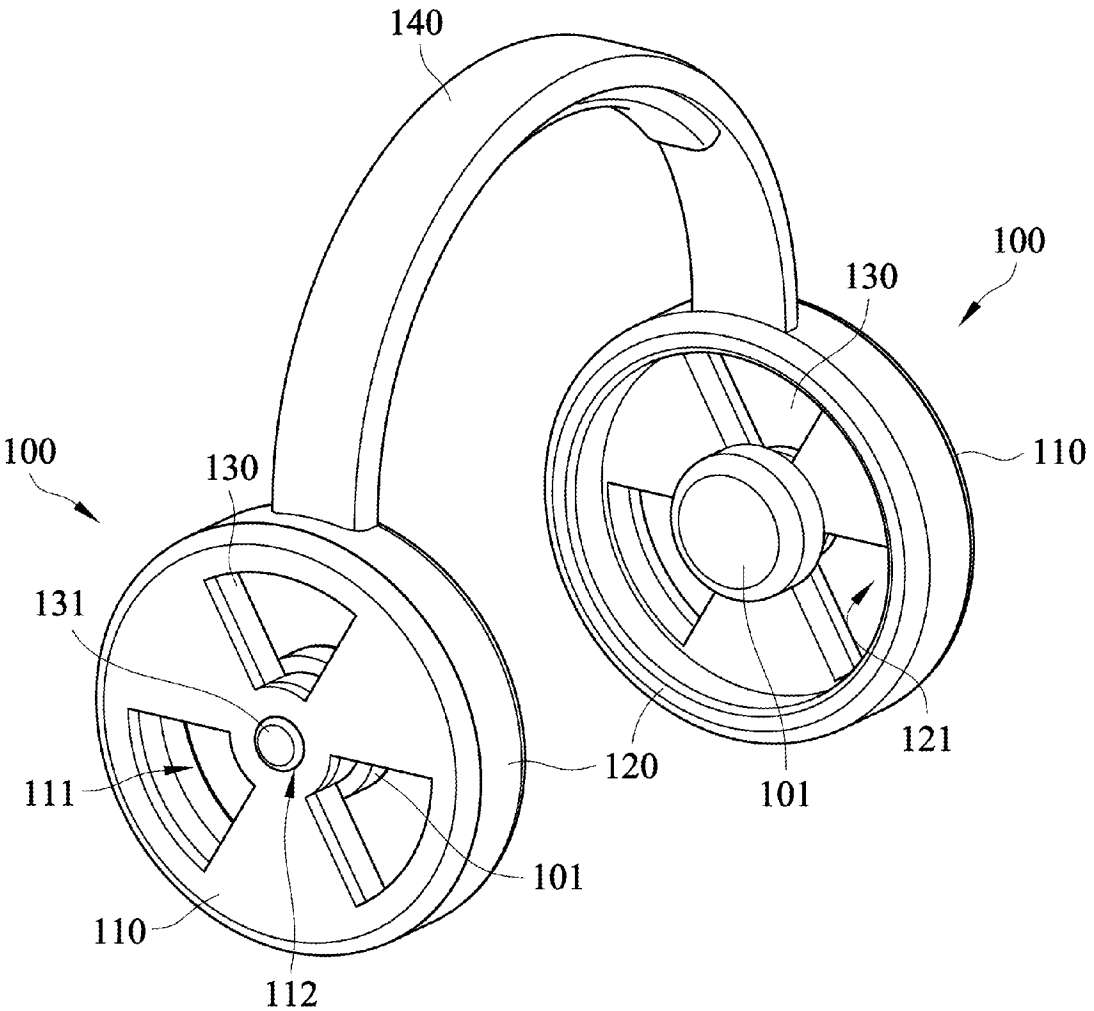
FIG. 9 illustrates a three-dimensional view of a headset of the first embodiment according to the present invention.

FIG. 9 illustrates a three-dimensional view of a headset of the first embodiment according to the present invention.

The headset includes at least two drivers 101, two earmuffs 100 each including a first case 110 and a second case 120 and a headband 140 connected between the two earmuffs 100 for fitting over the head. The first case 110 has a first through hole 111 defined thereon and the second case 120 has a second through hole 121 defined thereon. The second case 120 is accommodated within the first case 110 to form an inner chamber in which the drivers 101 are disposed therein. Furthermore, air flows between the first case 110 and the second case 120 via the first through hole 111 and the second through hole 121.

The number of the first through hole 111 and the second through hole 121 could be one or more. However, as mentioned above, the numbers of the first through hole 111 and the second through hole 121 in this embodiment are illustrative rather than limitative, and the present invention is not limited thereto.

Figure 10:
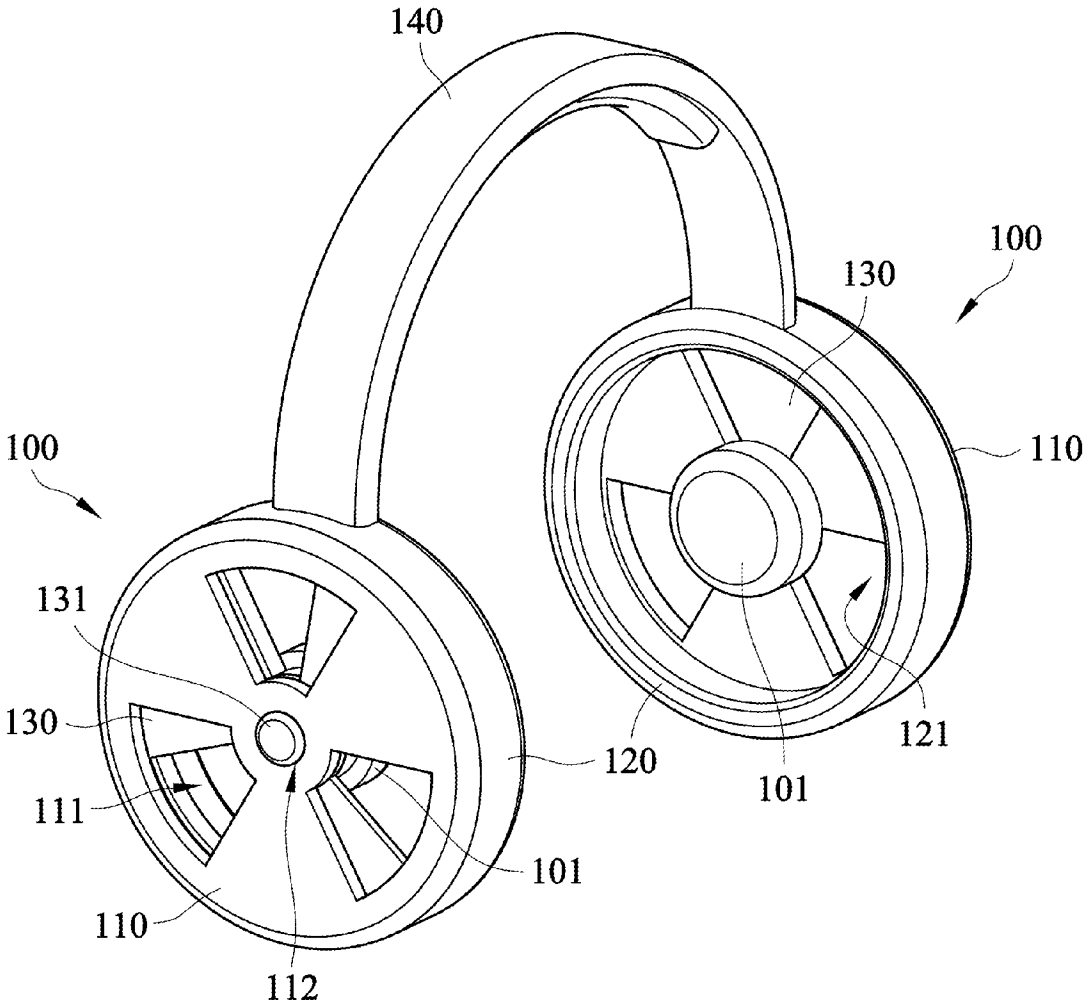
FIG. 10 illustrates a three-dimensional view of a headset of the second embodiment according to the present invention.

FIG. 10 illustrates a three-dimensional view of a headset of the second embodiment according to the present invention. The structure of the headset of the present embodiment is similar to the aforesaid embodiment except the headset of the present invention further includes a shelter 130 between the first case 110 and the second case 120.

A pivot 131 is provided to the shelter 130 and a corresponding pivotal hole 112 for inserting the pivot 131 that is provided on the first case 110. The shelter 140 is capable of rotating optionally to a fully-closed, semi-closed or an open position with respect to the first case 110. The structure of the present embodiment is similar to the eighth embodiment illustrated in FIGS. 8A to 8C, so the detailed description is not repeated here.

To sum up, the earmuff and the headset with the same of the present invention provide not only more integrated functions but also better sound quality and the problems caused by the enclosed structure of the conventional earmuff by introducing the design of the through hole. The through hole defined on the earmuff facilitates air flow for the heat dissipation via convection.

Also, for the purpose of the external noise attenuation, the circumference of the through holes defined on the first and second cases are different from each other, and the location of the driver in the earmuff is coordinated to form a substantial sound wall barrier system. In brief, the earmuff and the headset of the present invention may meet the requirements of both the sound quality and the ventilation effect.

In addition, the shelter of the present invention makes it possible for the wearer to determine by himself/herself whether to open the through hole or not. In this way, the wearer is allowed to adjust the sound quality and comfortableness at his/her own option easily.

While the disclosure has been described in terms of what is presently considered to be the preferred embodiments, it is to be understood that the disclosure needs not be limited to the disclosed embodiment. On the contrary, it is intended to cover various modifications and similar arrangements within the spirit and scope of the appended claims which are to be accorded with the broadest interpretation so as to encompass all such modifications and similar structures. It is therefore intended by the appended claims to define the true scope of the invention.

The invention claimed is:

1. An earmuff adapted to covering a driver, comprising:

a first case having a first through hole defined thereon;

a second case accommodated within the first case, having a second through hole defined thereon, and forming an inner chamber in which the driver is disposed therein; and a shelter having a pivot and disposed between the first case and the second case, the first case further having a pivotal hole for inserting the pivot, the shelter being capable of rotating to a fully-closed, semi-closed or an open position with respect to the first case.

2. The earmuff of claim 1, wherein the first through hole and the second through hole are disposed correspondingly.

3. The earmuff of claim 2, wherein a circumference of the first through hole is relatively smaller than that of the second through hole.

4. The earmuff of claim 1, wherein the first through hole and the second through hole are arranged in any of various zigzags, alternations, or overlapping of position.

5. The earmuff of claim 4, wherein a circumference of the first through hole is relatively smaller than that of the second through hole.

6. The earmuff of claim 1, wherein the second through hole is formed in accordance with the position of the driver.

7. A headset comprising:

at least two drivers;

two earmuffs each comprising:

a first case having a first through hole defined thereon;

a second case accommodated within the first case, having a second through hole defined thereon, and forming an inner chamber in which the drivers are disposed therein; and a shelter having a pivot and disposed between the first case and the second case, the first case further having a pivotal hole for inserting the pivot, the shelter being capable of rotating to a full-closed, semi-closed or an open position with respect to the first case; and a headband connected to the two earmuffs respectively.

* * * * *